US010934725B2

(12) United States Patent
Suwyn et al.

(10) Patent No.: US 10,934,725 B2
(45) Date of Patent: Mar. 2, 2021

(54) ANGLE TAPPING BLOCK

(71) Applicant: Crain Cutter Company, Inc., Milpitas, CA (US)

(72) Inventors: Donald W. Suwyn, Hastings, MI (US); Lance Darrell Crain, Pleasanton, CA (US); Darwin D. Spencer, Jr., Centennial, CO (US)

(73) Assignee: CRAIN CUTTER COMPANY, INC., Milpitas, CA (US)

( * ) Notice: Subject to any disclaimer, the term of this patent is extended or adjusted under 35 U.S.C. 154(b) by 0 days.

(21) Appl. No.: 16/788,234

(22) Filed: Feb. 11, 2020

(65) Prior Publication Data

US 2020/0256069 A1 Aug. 13, 2020

Related U.S. Application Data

(60) Provisional application No. 62/804,247, filed on Feb. 12, 2019.

(51) Int. Cl.
*E04F 21/20* (2006.01)

(52) U.S. Cl.
CPC ..... *E04F 21/20* (2013.01)

(58) Field of Classification Search
CPC ..... E04F 21/20; E04F 21/22
See application file for complete search history.

(56) References Cited

U.S. PATENT DOCUMENTS

| | | | | |
|---|---|---|---|---|
| 1,161,207 | A * | 11/1915 | Hagel | E04F 21/22 81/46 |
| 2,864,581 | A * | 12/1958 | Harrison | E04F 21/22 254/15 |
| 5,527,014 | A * | 6/1996 | Bracewell | B66F 19/00 254/15 |
| 6,715,253 | B2 | 4/2004 | Pervan | |
| 10,494,823 | B2 * | 12/2019 | Jacober | B25D 17/02 |
| 2018/0230700 | A1 * | 8/2018 | O'Connor | E04F 21/22 |

* cited by examiner

*Primary Examiner* — Patrick J Maestri
(74) *Attorney, Agent, or Firm* — Fenwick & West LLP

(57) ABSTRACT

An angle tapping block allows for lifting a flooring plank from a subfloor surface and tapping the flooring plank. The angle tapping block includes a beating block that has multiple surfaces, including a beating block beating surface for beating with a hammer and a beating block tapping surface for tapping the side of the flooring plank. The angle tapping block also includes a lifter plate attached to the beating block and positioned below the beating block. The lifter plate can be placed beneath a flooring plank and lift from the subfloor surface for tapping.

21 Claims, 5 Drawing Sheets

ANGLE TAPPING BLOCK

CROSS REFERENCE TO RELATED APPLICATIONS

This application claims the benefit of U.S. Provisional Application No. 62/804,247, filed Feb. 12, 2019, which is incorporated by reference in its entirety.

BACKGROUND

"Click-lock" flooring is generally a plank or tile flooring with co-acting tongue and groove joint structures. In the process of connecting and laying these planks or tiles to the floor, their joints tend to draw together tightly and lock without the use of adhesives. In one example, U.S. Pat. No. 6,715,253 B2 to Pervan, FIG. 9 shows floorboard 1 with a groove 36 and a locking surface 10, while floorboard 1' has a tongue 38 and a locking surface 11. Floorboard 1 is laid flat on a subfloor surface, with groove 36 facing out. Tongue 38 of floorboard 1' is pointed at groove 36 of floorboard 1 at a downward angle. As tongue 38 of floorboard 1' enters groove 36 of floorboard 1, locking surface 10 of floorboard 1 co-acts with locking surface 11 of floorboard 1', drawing and locking tongue 38 and groove 36 together. This process of installation is sometimes referred to as "inward angling" or just "angling." Many different geometries of tongue and groove and locking edge profiles have been created by different manufacturers of the flooring, but angling is how most of the joints are put together and locked.

The co-action of locking surfaces 10 and 11 is designed to draw floorboard 1' tightly against floorboard 1, without the use of tools. Once locked together, floorboard 1 and 1' should not be able to be separated. However, at that point, floorboards 1 and 1' also can no longer be pushed any closer together. Unfortunately, if there is any variation in the shapes of the tongues and grooves, there can be some undesirable gapping at the joints. Furthermore, different tongue and groove profiles can lock more or less tightly together than others.

If adjustment is needed to get the floorboard 1' to fit more tightly against floorboard 1, floorboard 1' must be lifted again to the angle at which the joint is unlocked, and then pushed or tapped somehow to fit more tightly against floorboard 1. One way to force floorboard 1' more tightly against floorboard 1 is called "angle tapping." This involves the use of a prior art tapping along with a hammer. As shown in FIG. 1, prior art tapping block 50 has a recess 51 that could fit against an outer edge of Pervan's floorboard 1'. However, tapping floorboard 1' with prior art tapping block 50 while it is in the angled position can be difficult. With one hand on the prior art tapping block, and the other hand on the hammer, it becomes difficult to also hold floorboard 1' up at the necessary angle. Indeed, as shown in FIG. 2, prior art tapping block 50 was designed for use on prior art floorboards 52, which have square tongue and groove joints, and which were joined together while flat on the floor. Prior art tapping block 50 has no features that are useful to hold a floorboard off the floor at the necessary angle for angle tapping. Even if prior art tapping block 50 had a feature to get under and lift a floorboard 1', it might be difficult to hold floorboard 1' at a desired angle. As shown in FIG. 2, with the orientation of handle 53 being parallel to the plank, rather than at a right angle to the plank, the wrist and the plank would both have a tendency to pivot from the desired angle. Indeed, prior art tapping block 50 does not have features to contact and stabilize a floorboard 1' by contact from a top surface of the floorboard 1', or a bottom surface of the floorboard 1' in a process of angle tapping. Prior art tapping block 50 is only designed to contact the side of prior art floorboards 52 to tap them.

U.S. Pat. No. 6,715,253 B2 describes the floorboards as being made with an "upper surface layer," a "fibreboard core," and a "lower balancing layer." This method of construction is highly versatile, and so floorboards of this kind with a wide variety of joint profiles, and overall floorboard lengths, widths, and thicknesses have been produced. As far as thicknesses, floorboards from 3 mm to 10 mm thick are most common. For the joint profiles, a wide variety of different multifaceted co-acting tongue and groove joint profiles have been produced. However, as shown in FIG. 1, prior art tapping block 50 has only a recess 51 with a fixed square shape that is not adjustable to fit different tongue and groove profiles, or to fit different thicknesses of these floorboards, for that matter.

Therefore, a tapping block is needed that can better assist in the process of angle tapping floorboards. Such a tapping block should also be adjustable to fit the wide variety of tongue and groove joint profiles and floorboard thicknesses that are encountered.

SUMMARY

In one embodiment, the angle tapping block includes a beating block that contacts the side of the floorboard (plank) at a surface on the edge of the plank where it can be tapped, and a lifter plate fastened to the beating block which can lift and hold the plank at the angle at which it can be angle-tapped. In one embodiment, the lifter plate includes a beveled edge, making it more easily insertable beneath the plank.

In another embodiment, the angle tapping block includes a beating block, a lifter plate, and a plurality of shims which are insertable between the lifter plate and the beating block. The shims adapt the device to planks of different thicknesses. In one embodiment, shims of different thicknesses are used, allowing the shims to be used in different combinations as needed for different thicknesses of planks. In another embodiment, the beating block and shims are mounted over threaded posts mounted on the lifter plate, and the shims are mounted over the threaded posts as by open-ended slots, allowing the shims to be easily inserted or removed. In another embodiment, the shims have a tab extending from their side surface to allow them to be individually removed from a stack of shims more easily.

In another embodiment, the angle tapping block includes a beating block, a lifter plate, and a contact plate. The contact plate contacts and impacts the plank at a lower surface on the edge of the plank than the beating block. The contact plate may include slots allowing it to be slidably mounted over the threaded posts on the lifter plate. The contact plate may be placed directly on top of the lifter plate, or any number of shims may be placed beneath the contact plate to space it from the top of the lifter plate. Thus, the contact plate can be positioned at various spacings from the lifter plate on shims, and is also slidable in the direction of the plank to contact the plank by way of its slots, to adjustably contact the plank at various points on either the tongue or the groove edge of the plank.

In another embodiment, the angle tapping block includes a beating block, a lifter plate, and a body extension plate attached to the beating block. In one embodiment, the body extension plate is attached at an elevation on an inner side surface of the beating block. Below the body extension plate, a lower inside surface on the beating block has a convenient height for tapping the upper edge portion of a variety of planks. In another embodiment, when a plank is inserted between a bottom surface of the body extension plate, and a top surface of the lifter plate, the bottom surface of the body extension plate and the top surface of the lifter plate contact the plank to stabilize it when it is lifted from a subfloor surface. In another embodiment, the body extension plate is long enough to produce downward pressure on the angled plank, near the tongue and groove joint, so that the planks do not come apart at the joint during the process of angle-tapping. In another embodiment, the body extension plate includes a protective covering on its bottom surface to prevent scratching the surface of the plank. In another embodiment, the body extension plate includes a handle for lifting the plank to the necessary angle. In another embodiment, the handle is at approximately a right angle to the beating block element, so that putting pressure on the handle puts pressure on the beating block element in a direction that tightens the joint between the two planks.

In another embodiment, the tapping block includes a beating block, and a body extension plate, and an area of the beating block beneath the body extension plate forms a surface lower for tapping the upper edge portion of a variety of planks.

In another embodiment, the tapping block includes a beating block having a bottom surface, a plurality of shims, and a contact plate that includes a slot, and the contact plate is slidably fastened to the beating block by a fastener through the slot in the contact plate.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 3:
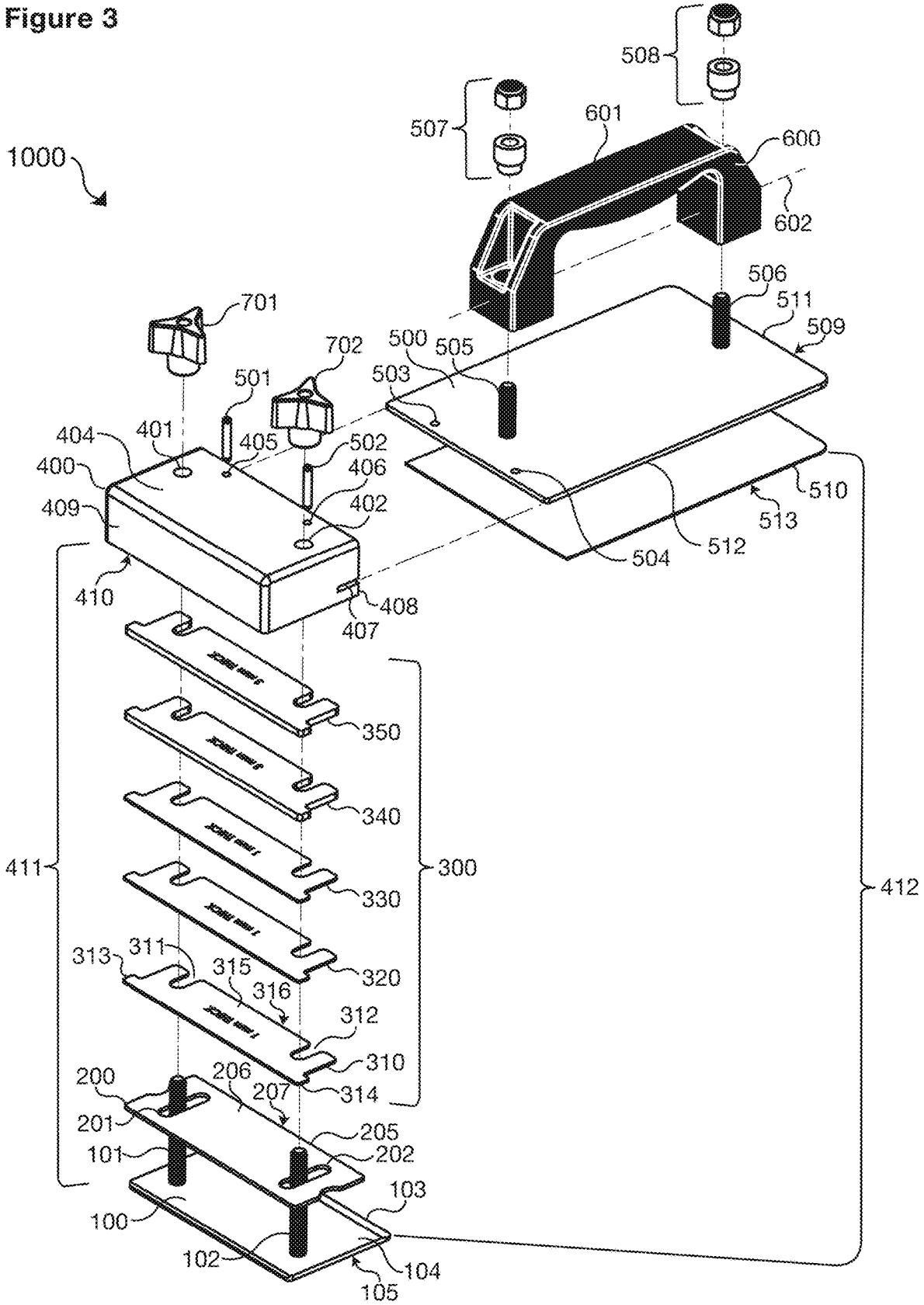
FIG. 3 is a partially exploded view of an angle tapping block according to an embodiment of the invention.

As shown in FIG. 3, angle tapping block 1000 includes a lifter plate 100, contact plate 200, a plurality of shims 300, a beating block 400, an extension plate 500, a handle 600, and nuts 701, 702. Attached to lifter plate 100 are threaded posts 101, 102, which are flush-mounted to lifter plate 100, and a beveled edge 103. Beveled edge 103 easily gets beneath a plank to lift it to the necessary angle for tapping, while a lifter plate top surface 104 can hold the plank up at the necessary elevation for tapping. Lifter plate 100 has a bottom surface 105 which defines the bottom or bottommost surface of angle tapping block 1000.

Contact plate 200 is mounted by placing slots 201, 202 over threaded posts 101, 102. Depending on the profile of the joint edge to be tapped, contact plate 200 can simply be used as a shim to space beating block 400 above lifter plate top surface 104. Slots 201, 202 additionally permit contact plate 200 to slide in the direction of a plank so that edge 205 contacts a surface on the edge of the plank to be tapped. Tapping the plank with both beating block 400 and contact plate 200 better distributes the tapping force against the edge of the plank being tapped, protecting it from being easily damaged. In the embodiment of FIG. 3, contact plate 200 has closed ended slots, but contact plate 200 may also have open ended slots, to allow contact plate 200 to be more easily inserted or removed without removing nuts 701, 702, or beating block 400, or any of a plurality of shims 300.

A plurality of shims 300 are mounted over threaded posts 101, 102. These can be placed on top of contact plate 200, or if contact plate 200 is not included, then on top of lifter plate 100. Furthermore, any of the plurality of shims 300 may be placed beneath the contact plate 200 to adjustably space it to contact a different surface of the edge of the plank to be tapped. Any of the plurality of shims 300 may be inserted or removed to space beating block 400 to contact a surface on the edge of the plank to be tapped. A shim 310 has open-ended slots 311, 312 for mounting over threaded posts 101, 102. A shim 310 also has finger tabs 313, 314, allowing shim 310 to be easily inserted or removed from any stack of the plurality of shims mounted on angle tapping block 1000 at the time. In one embodiment, plurality of shims 300 includes three shims 310, 320 and 330 which are 1 mm in thickness, two shims 340 and 350 which are 3 mm in thickness, and a contact plate 200 with a thickness of about 1.5 mm is also included. In that embodiment, contact plate 200 can be stacked with any of plurality of shims 300 to create stack heights from 1.5 mm to 10.5 mm, to accommodate plank thicknesses from 1 mm to 10 mm, while still providing about 0.5 mm of clearance.

Beating block 400 has post holes 401, 402 allowing it to be mounted over threaded posts 101, 102 and placed on top of any of lifter plate 100, contact plate 200, or any of the plurality of shims 300, as desired. Thus, beating block 400 can be adjustably spaced to contact a surface on the edge of the plank to be tapped. Beating block 400 has a beating block bottom surface 410. The vertical distance between beating block bottom surface 410 and lifter plate top surface 104 is a gap which will be referred to herein as shim insertion area 411. Shim insertion area 411 is an area at which contact plate 200 or any of a plurality of shims 300 is positionable. In the embodiment of FIG. 3, contact plate 200 or any of a plurality of shims 300 is positionable as by mounting them over threaded posts 101, 102.

Extension plate 500 is inserted into slot 407 of beating block 400. Extension plate 500 is fastened to beating block 400 by pressing pins 501, 502 into pin holes 405, 406. Pins 501, 502 are further pressed through pin holes 503, 504 of extension plate 500. Beneath slot 407 of beating block 400 where extension plate 500 is inserted, beating block 400 forms lower inside tapping surface 408, which is of convenient height for tapping against an upper edge area of click joint planks.

Extension plate 500 further includes flush-mounted threaded posts 505, 506 for mounting handle 600 using fasteners 507, 508. Handle 600 has a handle top surface 601 which defines the top or topmost surface of angle tapping block 1000. Extension plate 500 has a cover 510 affixed to extension plate bottom surface 509 to prevent it from scratching the face of the plank. Extension plate 500 includes an extension plate long side 512 defining the length of extension plate 500, and an extension plate front side 511, which defines the front of angle tapping block 1000.

Contact plate 200 has a contact plate top surface 206 and a contact plate bottom surface 207, shim 310 has a shim top surface 315 and a shim bottom surface 316, and similarly all other of a plurality of shims 300 have a shim top surface and a shim bottom surface. As shown in the embodiment of FIG. 3, contact plate 200 is mounted over threaded posts 101, 102 with its contact plate bottom surface 207 set on top of lifter plate top surface 104, and plurality of shims 300 is mounted over threaded posts 101, 102 with a shim bottom surface on top of a contact plate top surface 206 (or shim top surface, as the case may be). Beating block bottom surface 410 is placed on top of a shim top surface.

In the adjustment of the device, adding any of contact plate 200 or any of plurality of shims 300 beneath beating block bottom surface 410 as by mounting them over threaded posts 101, 102 and stacking atop lifter plate top surface 104 spaces beating block bottom surface 410 from lifter plate top surface 104. Once a desired combination of contact plate 200, and any of the plurality of shims 300 is stacked on lifter plate 100, any other unneeded plurality of shims 300 (or contact plate 200) is set atop beating block 400 at beating block top surface 404. Nuts 701, 702 are tightened to hold the device together in a configuration.

Figure 4:
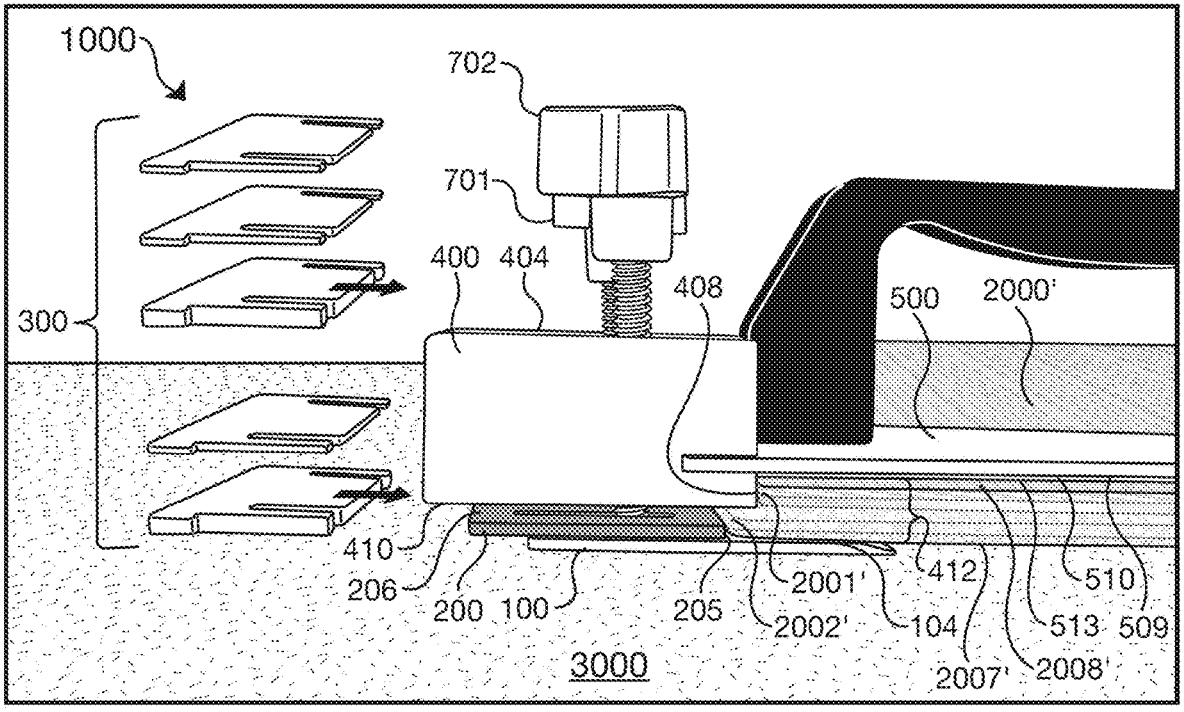
FIG. 4 illustrates adjustment of the angle tapping block of FIG. 3 to a groove side of a plank, in accordance with an embodiment of the invention.

To adjust the device to the groove side of a plank, as shown in FIG. 4, extension plate 500 is set on top of a plank 2000', and nuts 701, 702 are fully loosened. The plurality of shims 300 is temporarily removed, and contact plate 200 and lifter plate 100 fall to a subfloor surface 3000. A lower inside tapping surface 408 of beating block 400 is pushed against an upper plank groove edge surface 2001' where plank 2000' can be tapped without being easily damaged. In the process, in the embodiment shown in FIG. 4, plank 2000' enters a plank insertion area 412, which is defined as the vertical distance between a bottom surface 513 of cover 510 and lifter plate top surface 104. In alternative embodiments, if cover 510 were not included, the plank insertion area would be from extension plate bottom surface 509 to lifter plate top surface 104, or if extension plate 500 were not included, the plank insertion area would be from a beating block bottom surface 410 to lifter plate top surface 104.

As shown in FIG. 4, after plank 2000' is inserted at plank insertion area 412, contact plate 200 is slid in the direction of plank 2000' to contact a lower plank groove core surface 2002'. This is possible because contact plate 200 is slidably and extendably mounted over threaded posts 101, 102 (FIG. 3) by slots 201, 202 (FIG. 3). Thus, contact plate 200 taps the edge of plank 2000' at a point (lower plank groove core surface 2002') which is beneath the point (upper plank groove edge surface 2001') that the beating block tapping surface taps the edge of plank 2000'. Any of a plurality of shims 300 necessary to fill the gap between a contact plate top surface 206 and beating block bottom surface 410 are inserted. Any unneeded plurality of shims 300 can be placed on top of beating block 400 at beating block top surface 404, and nuts 701, 702 are tightened to hold the device together in a configuration.

Figure 5:
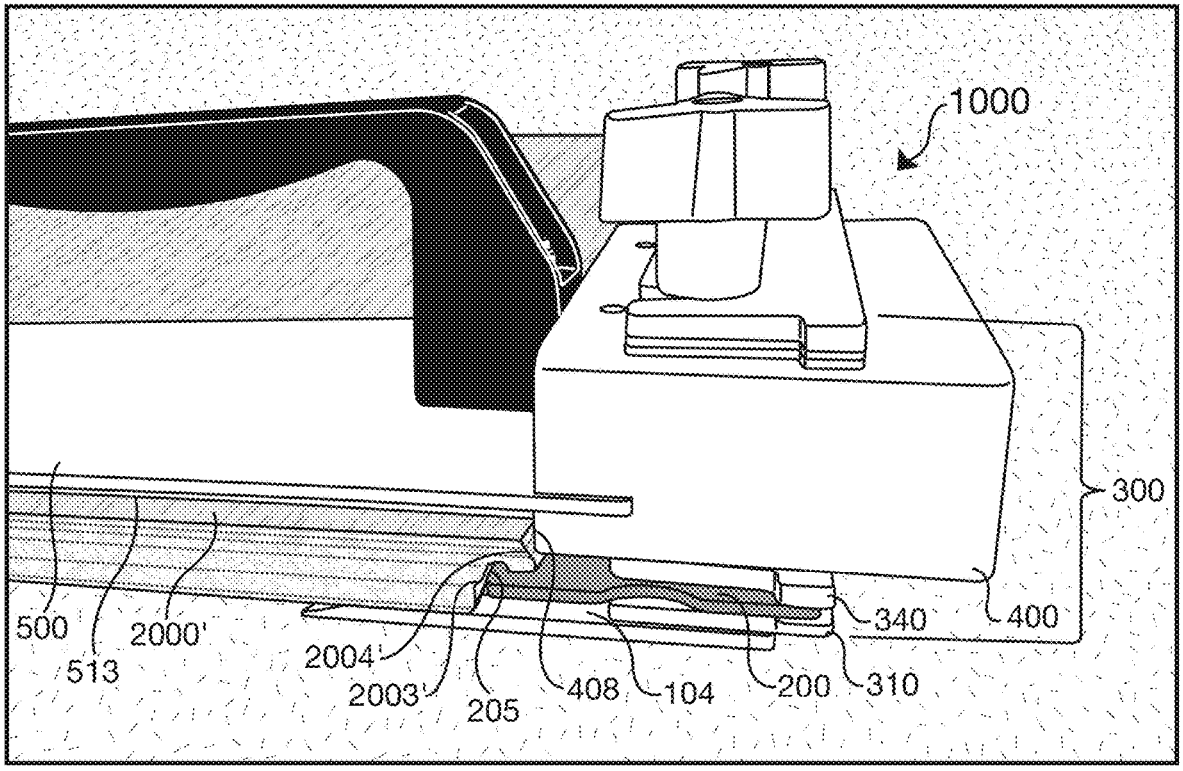
FIG. 5 illustrates adjustment of the angle tapping block of FIG. 3 to a tongue side of a plank, in accordance with an embodiment of the invention.

Adjusting the device to the tongue side of a plank is done in a similar manner. As shown in FIG. 5, a shim 310 which is a 1 mm thick shim may be placed beneath contact plate 200 to space it from lifter plate top surface 104. Contact plate 200 is spaced from a lifter plate top surface 104 such that edge 205 contacts a middle plank tongue core surface 2003' of plank 2000' where it can be tapped without being easily damaged. A shim 340 which is a 3 mm thick shim is placed on top of contact plate 200 to space beating block 400 so that lower inside tapping surface 408 contacts upper plank tongue edge surface 2004' where plank 2000' can be tapped without being easily damaged.

Figure 6:
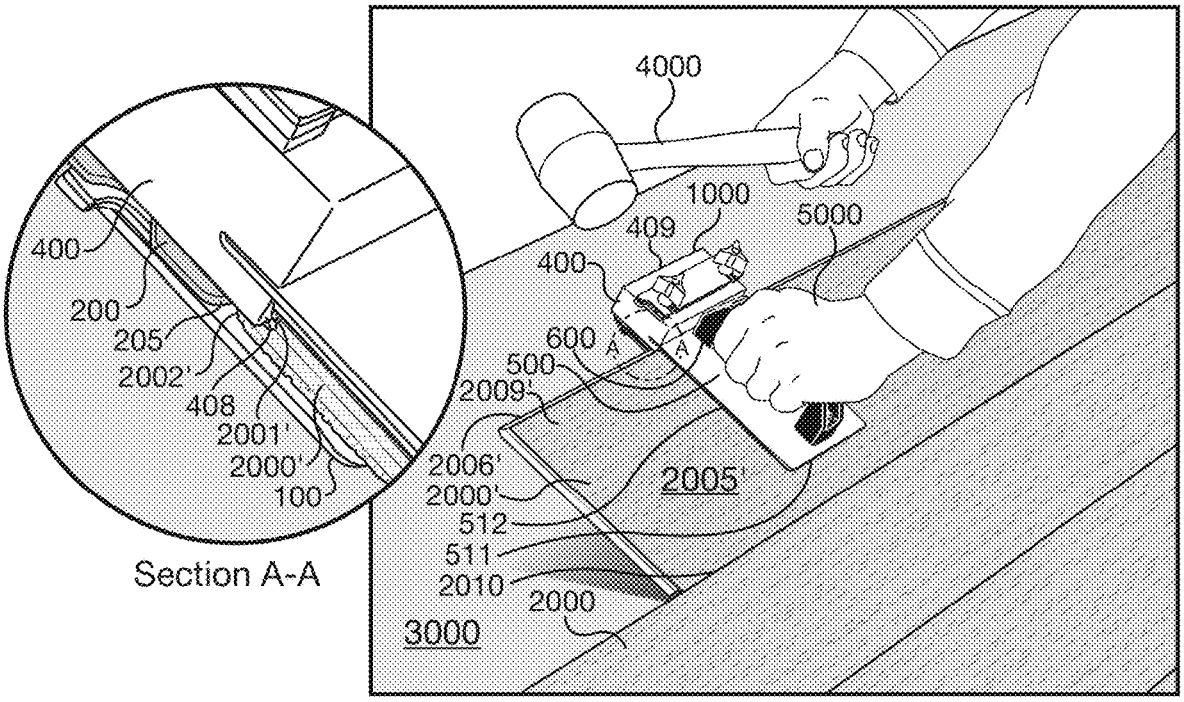
FIG. 6 illustrates an installation of a plank using the angle tapping block of FIG. 3, in accordance with an embodiment of the invention.

Angle tapping block 1000 is shown in use in FIG. 6, which also includes a partial Section A-A of plank 2000' to better show the device at work beneath plank 2000'. As shown in FIG. 6, angle tapping block 1000 is pushed against a groove edge 2006' of a plank 2000'. The lifter plate 100 (Section A-A) raises plank 2000' to an angle at which it can be unlocked from plank 2000. The joint 2010 between plank 2000 (laying flat on a subfloor 3000), and plank 2000', is to be tightened. As shown in Section A-A, contact plate 200 has edge 205 that contacts plank 2000' at lower plank groove core surface 2002'. Beating block 400 has lower inside tapping surface 408 that contacts an upper plank groove edge surface 2001'. As used herein, lower inside tapping surface 408 of beating block 400 is a beating block tapping surface. As shown in FIG. 6, beating block 400 is beaten at beating surface 409 by mallet 4000 to tighten the joint. As used herein, beating surface 409 on beating block 400 for beating with a mallet or like device is a beating block beating surface. A width of beating surface 409 defines a width of angle tapping block 1000. After tightening, as plank 2000' is lowered to the subfloor, it is again locked with plank 2000 with any gap at the joint removed.

As shown in FIG. 6, the length of extension plate long side 512 of extension plate 500 produces downward pressure up to about surface 2005' of plank 2000' to hold the joint 2010 between plank 2000 and plank 2000' together as the process of angle tapping occurs. Without such pressure, the planks 2000 and 2000' can come apart at joint 2010.

As shown in FIG. 3, handle 600 has a handle long axis 602 which is oriented at about a right angle in relation to a lower inside tapping surface 408 of beating block 400. As shown in Section A-A of FIG. 6, beating block 400 contacts plank 2000' at lower inside tapping surface 408 to tighten its joint 2010 (FIG. 6) with plank 2000 (FIG. 6). As shown in FIG. 6, if plank 2000' is delicate, and it is not desirable to tap it with the force that mallet 4000 would generate, pressure from hand 5000 on handle 600 alone may be used to push plank 2000' against plank 2000 and close the joint 2010. This is convenient due to the right angle that handle 600 forms with lower inside tapping surface 408 (Section A-A) of beating block 400.

Figure 1:
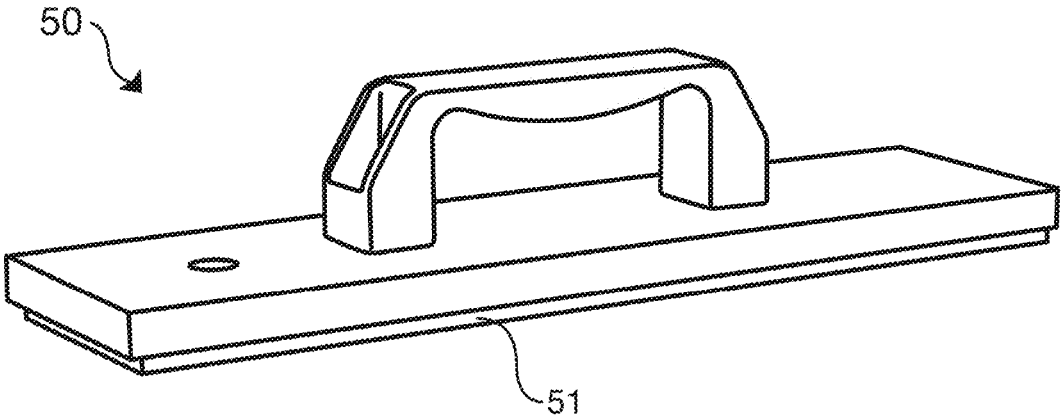
Figure 1 Prior Art
FIG. 1 is a prior art tapping block.
Figure 2:
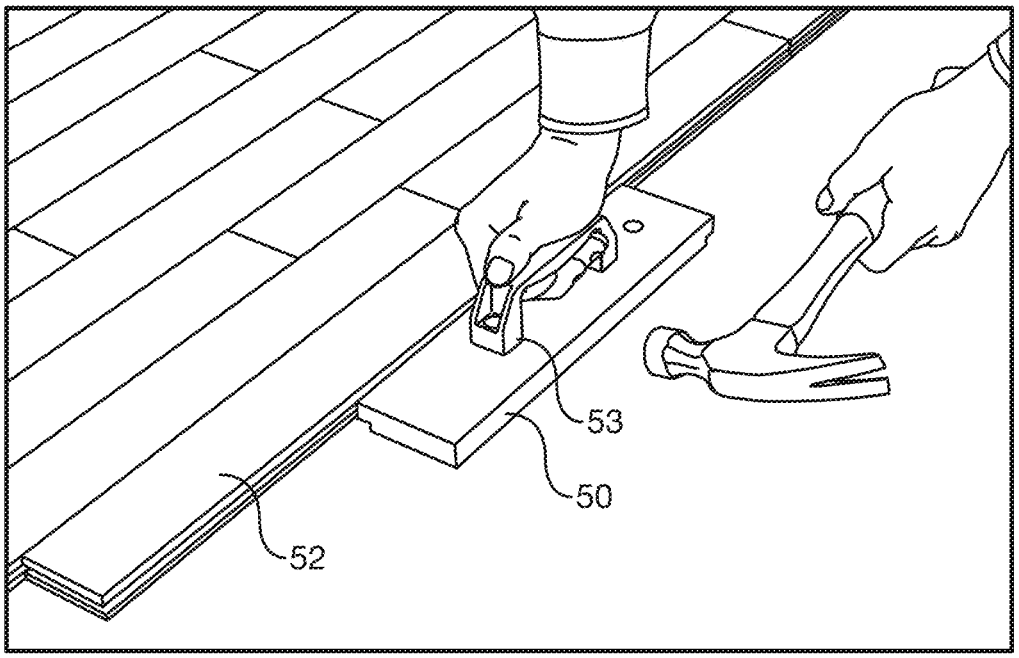
Figure 2 Prior Art
FIG. 2 depicts a use of the prior art tapping block of FIG. 1.

As shown in FIG. 4, due to the adjustable spacing between lifter plate top surface 104 and cover bottom surface 513, it is possible to fit angle tapping block 1000 closely to plank plank bottom surface 2007' and plank top surface 2008' of plank 2000'. These points of contact tend to stabilize plank 2000' when it is lifted off the subfloor to be angle tapped. With the plank 2000' being stabilized by being contact at these surfaces, plank 2000' tends not to pivot or fall. Moreover, with lifter plate top surface 104 in contact with plank bottom surface 2007', and cover bottom surface 513 in contact with plank top surface 2008', angle tapping block 1000 is also less prone to pivot at handle 600 (FIG. 6) once plank 2000' is lifted from the subfloor, as shown in FIG. 6. Furthermore, as shown in FIG. 6, the position of handle 600 also assists in the process of lifting plank 2000'. Extension plate 500 positions handle 600 over the top surface 2009' of plank 2000', which is an effective position for lifting and controlling plank 2000'. As shown in FIG. 2, prior art tapping block 50 (FIG. 2) is not configured to lift or hold prior art floorboards 52 at an angle for angle tapping, or to position its handle 53 over the top of the prior art floorboards 52 for conveniently lifting the floorboards 52 in a process of angle tapping.

As shown in FIG. 3, shim 310 has slots 311 and 312 which are open-ended. In one embodiment, each of a plurality of shims 300 also has open-ended shims. With the aforementioned embodiment, any of a plurality of shims can be conveniently inserted or removed from beneath beating block 400, or contact plate 200, without having to fully remove nuts 701, 702 to disassemble angle tapping block 1000. Shim 310 also has finger tabs 313, 314 which allow a finger to pull out a shim easily as needed in the process of adjustment, and in one embodiment, all of a plurality of shims 300 have such finger tabs. As used herein, a plurality of shims consists of one or more shims. One skilled in the art can appreciate that one shim or more than one shim can be inserted into the shim insertion area 411 to space beating block bottom surface 410 from lifter plate top surface 104, or to space contact place 200 from lifter plate top surface 104.

As shown in FIG. 3, contact plate 200, plurality of shims 300, and beating block 400 are mounted over threaded posts 101, 102 of lifter plate 100. As used herein, the term "mounted over" means the threaded posts 101, 102 are extended through holes (in the case of beating block 400), or through or into slots in the case of contact plate 200 or any of a plurality of shims 300, after which gravity would cause the elements being mounted to fall into a stack on top of lifter plate top surface 104.

As shown in FIG. 3, beating block 400 is shaped as a rectangular bar. However, one skilled in the art can appreciate that beating block 400 in alternative embodiments could be formed in other shapes, including as a L-shape with a recessed wall, with the recessed wall forming the beating block beating surface, and another surface forming the beating block tapping surface. Similarly, in alternative embodiments, other elements configured for beating could be added to the beating block to form a beating block beating surface, including added blocks or L-shaped members.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. An angle tapping block for lifting a first flooring plank from a subfloor surface and tapping the first flooring plank while the first flooring plank is joined at an angle with a second flooring plank laying on the subfloor surface, the angle tapping block comprising:

a beating block having a beating block beating surface for beating with a hammer, and further having a beating block tapping surface for tapping an edge of the first flooring plank, and further having a beating block bottom surface; and, a lifter plate fastened to the beating block and positioned under the beating block bottom surface, the lifter plate configured to be inserted beneath a flooring plank and to lift the first flooring plank from the subfloor surface for tapping.

2. The angle tapping block of claim 1, wherein the lifter plate includes a beveled edge for insertion beneath the first flooring plank.

3. The angle tapping block of claim 1, further comprising:

one or more shims positionable in a shim insertion area between the beating block bottom surface and a lifter plate top surface to space the beating block from the lifter plate.

4. The angle tapping block of claim 3, wherein the lifter plate further includes a threaded post for mounting at least one of the one or more shims.

5. The angle tapping block of claim 4, wherein one of the one or more shims includes an open-ended slot mountable over the threaded post.

6. The angle tapping block of claim 4, further comprising:

a contact plate including a slot mountable over the threaded post, the contact plate slideable in the direction of the first flooring plank to contact the edge of the first flooring plank when the first flooring plank is inserted in a plank insertion area of the angle tapping block.

7. The angle tapping block of claim 6, wherein the contact plate is positionable on top of one of the one more shims.

8. The angle tapping block of claim 3, wherein the one or more shims includes shims of different thicknesses.

9. The angle tapping block of claim 3, wherein one of the one or more shims includes a finger tab.

10. The angle tapping block of claim 1, further comprising:

a contact plate positionable in a shim insertion area between the beating block bottom surface and a lifter plate top surface, the contact plate configured for tapping the edge of the first flooring plank at a point on the edge of the first flooring plank beneath the point that the beating block tapping surface taps the edge of the first flooring plank.

11. The angle tapping block of claim 1, further comprising:

a body extension plate extending from the beating block tapping surface.

12. The angle tapping block of claim 11, wherein the body extension plate has an extension plate bottom surface having a length that transfers a pressure to a top surface of the first flooring plank keeping it joined with the second flooring plank.

13. The angle tapping block of claim 12, wherein the body extension plate further includes a cover affixed its extension plate bottom surface.

14. The angle tapping block of claim 11, wherein a handle is attached to the body extension plate.

15. The angle tapping block of claim 14, wherein the handle is attached to the body extension plate at a right angle to the beating block tapping surface.

16. The angle tapping block of claim 1, further comprising:

a handle having a long axis oriented at a right angle to the beating block tapping surface.

17. A tapping block for tapping a flooring plank, the tapping block comprising:

a beating block having a beating block beating surface for beating with a hammer, and further having a beating block tapping surface for tapping the edge of the flooring plank; and a body extension plate coupled to the beating block;

wherein a surface of the beating block beneath the body extension plate forms the beating block tapping surface.

18. An angle tapping block for lifting a first flooring plank from a subfloor surface and tapping the first flooring plank while the first flooring plank is joined at an angle with a second flooring plank laying on the subfloor surface, the angle tapping block comprising:

a beating block having a beating block beating surface for beating with a hammer, and further having a beating block tapping surface for tapping an edge of the first flooring plank, and further having a beating block bottom surface;

a body extension plate coupled to the beating block and extending from the beating block tapping surface; and, a lifter plate fastened to the beating block and positioned under the beating block bottom surface, the lifter plate configured to be inserted beneath the first flooring plank and to lift the first flooring plank from the subfloor surface for tapping;

wherein when the first flooring plank is inserted at a plank insertion area, the body extension plate contacts the first flooring plank on a flooring plank top surface, and the lifter plate contacts the first flooring plank on a first flooring plank bottom surface.

19. The angle tapping block of claim 18, further comprising:

a handle coupled to the body extension plate, the handle positioned over the first flooring plank is when it is inserted at a plank insertion area.

20. A tapping block for tapping a flooring plank, the tapping block comprising:

a beating block having a beating block beating surface for beating with a hammer, and further having a beating block tapping surface for tapping the edge of the flooring plank, and further having a beating block bottom surface;

one or more shims fastened to the beating block and positioned under the beating block bottom surface; and, a contact plate fastened to the beating block and positioned under the beating block bottom surface, the contact plate configured for tapping the edge of the flooring plank at a point on the flooring plank beneath the point that the beating block tapping surface taps the edge of the flooring plank.

21. The tapping block of claim 20, further comprising:

a threaded fastener fastening the contact plate to the beating block;

wherein the contact plate further includes a slot, and the contact plate is slidably fastened to the beating block with the threaded fastener through the slot of the contact plate.

* * * * *